US005931748A

United States Patent [19]

Hsieh

[11] Patent Number: 5,931,748

[45] Date of Patent: Aug. 3, 1999

[54] SHOCK-ABSORBING RACKET HANDLE

[76] Inventor: Chih-Ching Hsieh, No. 64, Lane 107, Liang Tsun Rd., Fong Yuan City, Taichung Hsien, Taiwan

[21] Appl. No.: 09/093,861

[22] Filed: Jun. 9, 1998

[51] Int. Cl.[6] ..... A63B 49/08

[52] U.S. Cl. ..... 473/523; 473/549

[58] Field of Search ..... 453/549, 523, 453/520, 521, 559, 568, 298, 300; 81/22, 489, 177

[56] References Cited

U.S. PATENT DOCUMENTS

| | | | |
|---|---|---|---|
| D. 245,443 | 8/1977 | Sweet | 473/551 X |
| 1,218,091 | 3/1917 | Lard | 473/298 |
| 4,907,810 | 3/1990 | Whiteford | 473/523 |
| 5,088,734 | 2/1992 | Glava | 473/523 |
| 5,135,223 | 8/1992 | You | 473/523 |
| 5,178,387 | 1/1993 | Kuebler | 473/523 |
| 5,240,247 | 8/1993 | Didier | 473/523 |
| 5,242,724 | 9/1993 | You | 473/521 |
| 5,269,516 | 12/1993 | Janes | 473/523 |
| 5,435,549 | 7/1995 | Chen | 473/523 |

*Primary Examiner*—Raleigh W. Chiu
*Attorney, Agent, or Firm*—Varndell Legal Group

[57] ABSTRACT

A shock-absorbing racket handle having a plurality of grooves and solid blocks alternatively arranged along the length of the body thereof, and a plurality of longitudinal ribs respectively disposed in the grooves and connected between each two adjacent solid blocks in a staggered manner.

2 Claims, 4 Drawing Sheets

SHOCK-ABSORBING RACKET HANDLE

BACKGROUND AND SUMMARY OF THE INVENTION

The present invention relates to a racket handle for a racket, and more particularly to a shock-absorbing racket handle which effectively lessens shock waves when the racket hits the ball.

The handle of a regular racket for tennis, badminton or table tennis may be made in a solid or hollow structure of cylindrical or polygonal cross section, and then packed with a plastic tape for positive gripping with the hand. This structure of handle can not effectively absorb or lessen shock waves transmitted from the head of the racket when the racket hits the ball. Therefore, the user's hand tends to be injured by shock waves transmitted from the head of the racket during the game.

The present invention provides a shock-absorbing racket handle for a racket which effectively lessens shock waves transmitted from the racket when the racket hits the ball. According to the invention, grooves and solid blocks are alternatively arranged on the body of the racket handle in longitudinal direction, and longitudinal ribs are connected between each two adjacent solid blocks in a staggered manner. This arrangement effectively lessens shock waves transmitted from the head of the racket.

DETAILED DESCRIPTION OF THE PREFERRED EMBODIMENT

Figure 1:
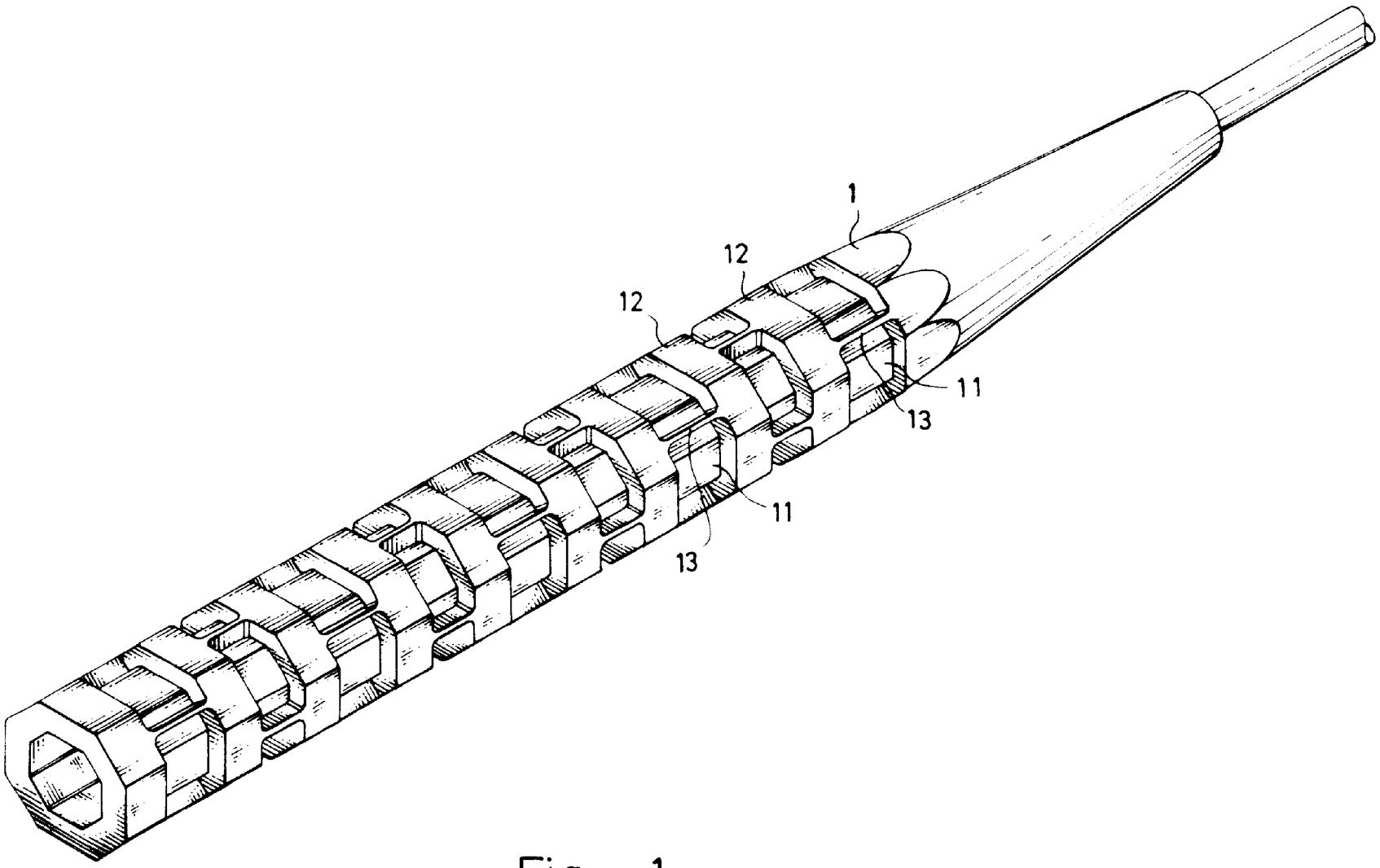
FIG. 1 is a perspective view of the body of a racket handle according to the present invention.
Figure 2:
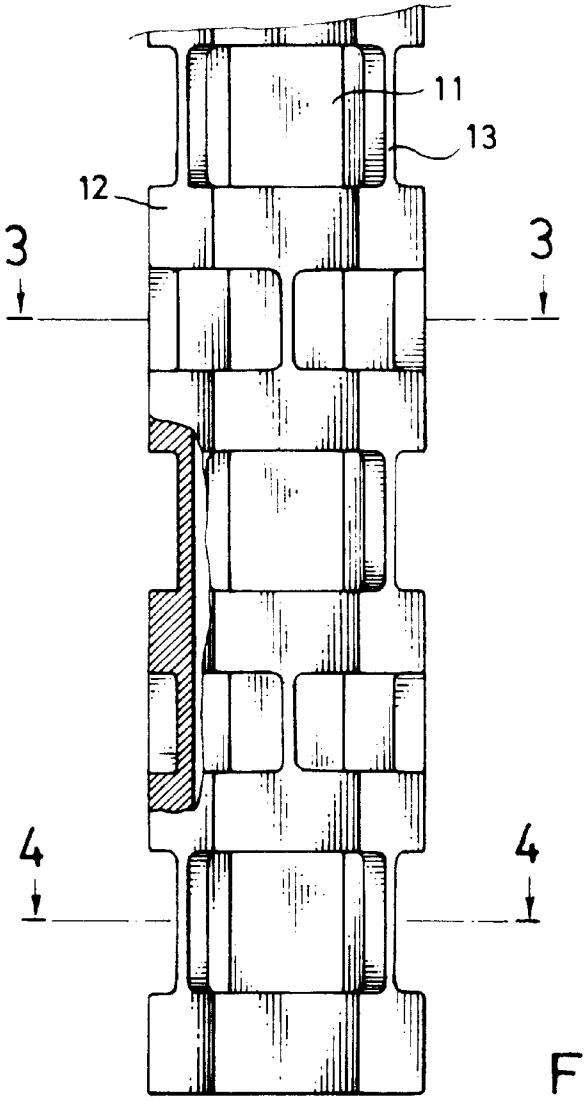
FIG. 2 is a sectional view of the body of the racket handle shown in FIG. 1.
Figure 4:
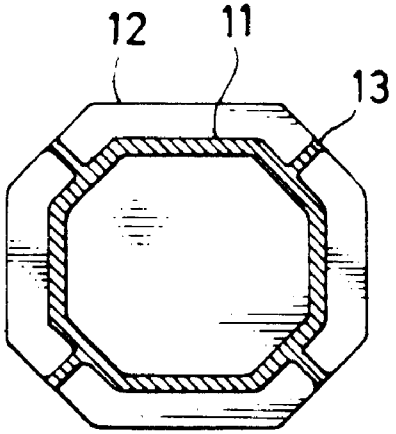
FIG. 4 is a sectional view taken along line 4—4 of FIG. 2.
Figure 3:
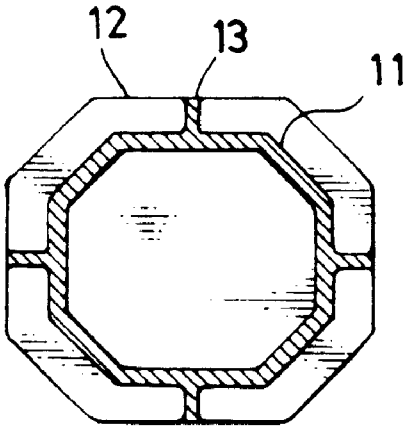
FIG. 3 is a sectional view taken along line 3—3 of FIG. 2.

Referring to FIGS. from 1 to 4, the body 1 of a racket handle according to the present invention comprises a plurality of grooves 11 and solid blocks 12 alternatively arranged along the length thereof, and a plurality of longitudinal ribs 13 respectively provided in the grooves 11 and connected between each two adjacent solid blocks 12 in a staggered manner. When the racket hits the ball, shock waves are produced and transmitted from the racket head to the body 1 of the racket handle. When shock waves are transmitted through the grooves 11 and the longitudinal ribs 13, they are lessened, therefore less shock waves are transmitted to the user's hand.

Figure 6:
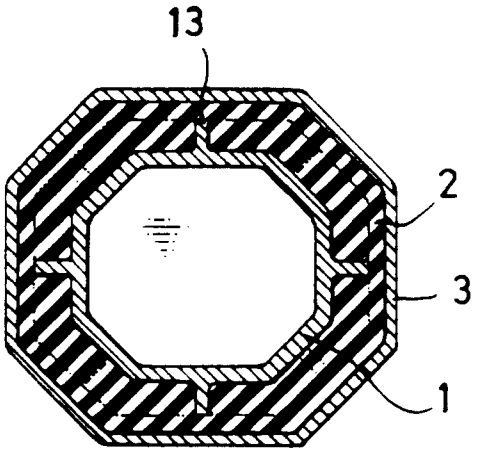
FIG. 6 is a sectional view taken along line 6—6 of FIG. 5.
Figure 5:
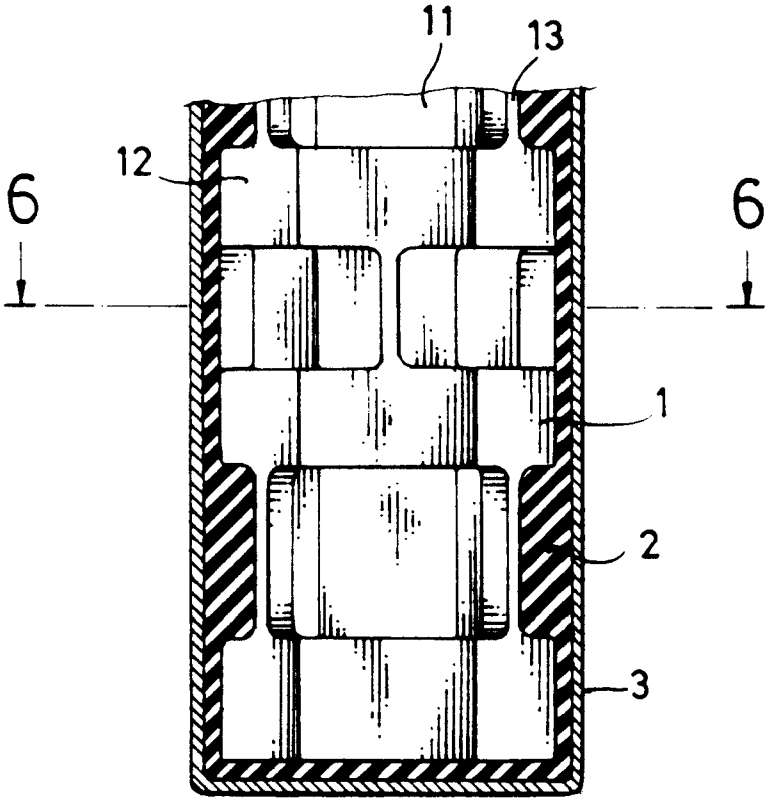
FIG. 5 is a longitudinal view in section of the present invention, showing rubber packing pads inserted into the grooves on the body of the handle, a plastic tape wound round the rubber packing pads, the solid blocks and the longitudinal ribs.

Referring to FIGS. 5 and 6, rubber packing pads 2 are inserted in the grooves 11 and maintained in flush with the solid blocks 12 and the longitudinal ribs 13, and then a plastic tape 3 is wound round the rubber packing pads 2, the solid blocks 12 and the longitudinal ribs 13.

I claim:

1. A shock-absorbing racket handle comprising an elongated body and a binding tape wound round said body, wherein said body comprises a plurality of grooves and solid blocks alternatively arranged along the length thereof, and a plurality of longitudinal ribs respectively disposed in said grooves and connected between each two adjacent solid blocks in a staggered manner.

2. The shock-absorbing racket handle of claim 1 further comprising a plurality of rubber packing pads respectively fitted into said grooves and wrapped by said binding tape.

* * * * *